US009964894B2

(12) United States Patent
Morita

(10) Patent No.: US 9,964,894 B2
(45) Date of Patent: May 8, 2018

(54) TONER CONTAINER AND IMAGE FORMING APPARATUS

(71) Applicant: KYOCERA Document Solutions Inc., Osaka (JP)

(72) Inventor: Takashi Morita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/532,104

(22) PCT Filed: Nov. 10, 2015

(86) PCT No.: PCT/JP2015/081568

§ 371 (c)(1),
(2) Date: Jun. 1, 2017

(87) PCT Pub. No.: WO2016/103932

PCT Pub. Date: Jun. 30, 2016

(65) Prior Publication Data

US 2017/0269506 A1 Sep. 21, 2017

(30) Foreign Application Priority Data

Dec. 25, 2014 (JP) ..... 2014-261890

(51) Int. Cl.
*G03G 15/08* (2006.01)

(52) U.S. Cl.
CPC ..... *G03G 15/0886* (2013.01); *G03G 15/0865* (2013.01)

(58) Field of Classification Search
CPC ..... G03G 15/0886; G03G 15/0865
See application file for complete search history.

(56) References Cited

U.S. PATENT DOCUMENTS 7,035,574 B2 * 4/2006 Deguchi ..... G03G 15/0872 222/DIG. 1
8,532,556 B2 9/2013 Yokokawa

FOREIGN PATENT DOCUMENTS

JP 2005-106896 A 4/2005
JP 2011-150319 A 8/2011

* cited by examiner

*Primary Examiner* — David M Gray
*Assistant Examiner* — Michael Harrison
(74) *Attorney, Agent, or Firm* — Studebaker & Brackett PC

(57) ABSTRACT

A toner container includes a container main body having a toner replenishment port and a shutter mechanism. The shutter mechanism has a shutter member having a discharge port and a cover member supported by the shutter member so as to extend toward the replenishment port. The shutter member is movable in an opening direction from a closing position where the discharge port is retracted from the replenishment port to an opening position where the discharge port is communicated with the replenishment port and in a closing direction from the opening position to the closing position. The cover member has a tip end portion that extends toward the replenishment port as the shutter member moves in the closing direction, comes into contact with a downstream side edge portion of the replenishment port at the closing position and retracts from the replenishment port as the shutter member moves in the opening direction.

9 Claims, 11 Drawing Sheets

TONER CONTAINER AND IMAGE FORMING APPARATUS

TECHNICAL FIELD

The present invention relates to a toner container containing a toner and an image forming apparatus including the toner container.

BACKGROUND

In an electrophotographic type image forming apparatus, a latent image formed on a surface of a photosensitive drum or the like is developed into a toner image by a development device. To the development device, a toner is supplied from a toner container such as a toner case or an intermediate hopper.

The toner container has a replenishment port through which the toner is supplied to the development device. The replenishment port is opened and closed by a shutter mechanism. An example of the shutter mechanism will be described with reference to FIG. 11A and FIG. 11B. In the shutter mechanism, a replenishment port 102 is formed in a duct 101 of a container main body, and a cylindrical shaped shutter member 104 is rotatably supported in the duct 101. On an outer circumferential wall of the shutter member 104, a discharge port 105 through which the toner is discharged is formed. Around the discharge port 105, a seal member 106 is provided. The shutter member 104 is rotated between an opening position (refer to FIG. 11A) where the discharge port 105 is communicated with the replenishment port 102 to allow the toner to be discharged from the container main body and a closing position (refer to FIG. 11B) where the discharge port 105 is retracted from the replenishment port 102 to restrict the replenishment of the toner to open and close the replenishment port 102.

In such a shutter mechanism, when the shutter member 104 is rotated in the counterclockwise direction (refer to an arrow in FIG. 11A) from the opening position to the closing position, the toner is scraped in the counterclockwise direction by side faces of the discharge port 105 and the seal member 106. Although almost of the scraped toner is fallen through the discharge port 105 into the replenishment port 102, a part of the scraped toner tends to adhere on an edge portion 102*a* of a downstream side face of the replenishment port 102 in a direction in which the shutter member 104 is rotated from the opening position to the closing position. As shown in FIG. 11B, if the adhered toner T is accumulated on the edge portion 102*a*, the adhered toner may be scattered or fallen around the replenishment port 102 and then contaminate the circumference.

Regarding the toner contamination, the Patent Document 1 discloses a toner container including a seal member arranged inside the replenishment port 102 of the duct 101. In addition, the Patent Document 2 discloses a toner container including a cover member rotatably provided outside a shutter mechanism. The cover member is configured to cover a circumference of the replenishment port to prevent the toner scattering.

PRIOR ART DOCUMENT

Patent Document

[Patent Document 1] Japanese Patent laid-open Publication No. 2005-106896

[Patent Document 2] Japanese Patent laid-open Publication No. 2011-150319

SUMMARY OF INVENTION

Problems to be Solved by the Invention

However, in the toner container described in the Patent Document 1 and the toner container described in FIG. 11A and FIG. 11B, because the shutter member is always rotated in the same direction toward the closing position, it is difficult to prevent the toner accumulation caused by the rotating direction of the shutter member, and thus the falling or scattering of the accumulated toner may be occurred. In the toner container described in the Patent Document 2, because a mechanism for rotating the cover member is required, the structure and control may be complicated.

The present invention has been made in view of the circumstance described above, and it is an object of the present invention to provide a toner container configured to prevent the toner contamination by the toner adhered on the replenishment port and an image forming apparatus including the toner container.

Means of Solving the Problems

To solve the above problems, a toner container according to the present invention includes a container main body having a replenishment port of a toner and containing the toner and a shutter mechanism which opens and closes the replenishment port. The shutter mechanism includes a shutter member having a discharge port corresponding to the replenishment port and a cover member supported by the shutter member so as to extend in a direction of the replenishment port. The shutter member is movable between an opening position where the discharge port is communicated with the replenishment port to open the replenishment port and a closing position where the discharge port is retracted from the replenishment port to close the replenishment port. The shutter member is movable in an opening direction from the closing position to the opening position and in a closing direction from the opening position to the closing position. The closing direction is opposite to the opening direction. The cover member has a tip end portion. The tip end portion extends toward the replenishment port as the shutter member moves from the opening position to the closing position, comes into contact with a downstream side edge portion of the replenishment port in the closing direction at the closing position and retracts from the replenishment port as the shutter member moves in the opening direction.

An image forming apparatus according to the present invention includes the above described toner container.

Effects of the Invention

According to the present invention, because the toner adhered on the edge portion of the replenishment port is held between the cover member and the edge portion, it becomes possible to prevent the toner contamination caused by falling of the adhered toner.

THE MODE FOR CARRYING OUT THE INVENTION

Hereinafter, with reference to figures, a toner container and an image forming apparatus according to an embodiment of the present disclosure will be described.

Figure 1:
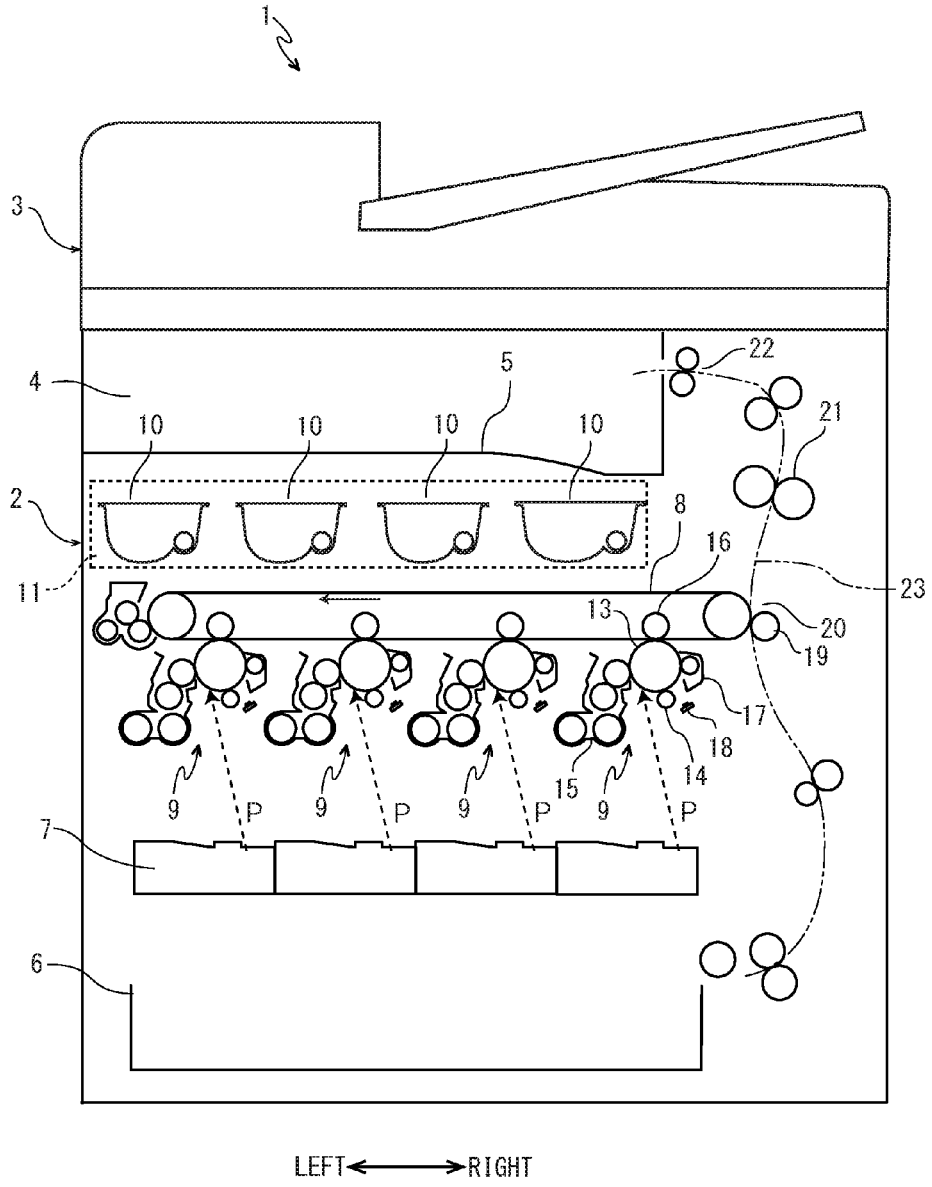
FIG. 1 is a view schematically showing a structure of a color printer according to an embodiment of the present invention.

With reference to FIG. 1, an entire structure of a color printer 1 as an image forming apparatus will be described. FIG. 1 is a front view schematically showing the entire structure of the color printer. In the following description, a near side of a paper plan of FIG.1 is set as a front side of the color printer, and left and right directions are based on a direction in which the color printer is seen from the front side.

As shown in FIG. 1, the color printer 1 includes an image forming part 2 and an image reading part 3 disposed above the image forming part 2.

The image forming part 2 has an in-body sheet ejection space 4 under the image reading part 3. The in-body sheet ejection space 4 opens to a front face and a left side face. Under the in-body sheet ejection space 4, a sheet ejection tray 5 is formed on an upper face of the image forming part 2. To a lower portion of the image forming part 2, a sheet feeding cassette 6 is attached. Above the sheet feeding cassette 6, an exposing device 7 having a laser scanning unit (LSU) is provided. Above the exposing device 7, an intermediate transferring belt 8 and four image forming units 8 are stored. The intermediate transferring belt 8 is supported by rollers. The four image forming units 9 are arranged along a lower portion of the intermediate transferring belt 8 side by side. Below the ejection tray 5, an attachment part 11 to which a toner container 10 (a toner case) containing each of four-color toner is attached is provided.

Each image forming unit 9 includes a photosensitive drum 13 that is a rotatable image carrier. Around the photosensitive drum 13, a charging device 14, a development device 15, a transferring roller 16, a cleaning device 17 and a static eliminating device 18 are arranged in the rotating direction of the photosensitive drum 13 in the order. Between the photosensitive drum 13 and the transferring roller 16, a first transferring part is formed.

At a right side of the intermediate transferring belt 8, a transferring roller 19 is arranged. Between the intermediate transferring belt 8 and the transferring roller 19, a second transferring part 20 is formed. Above the second transferring part 20, a fixing device 21 is provided. Above the fixing device 21, a sheet ejection device 22 facing the ejection tray 5 is provided. In addition, a sheet conveying path 23 is formed so as to extend from the sheet feeding cassette 6 to the sheet ejection device 22 through the second transferring part 20 and the fixing device 21.

An operation of forming an image by the color printer 1 having such a configuration will be described. In each image forming unit 9, a surface of the photosensitive drum 13 is electrically charged by the charging device 14 and then exposed with a laser light (refer to an arrow P) by the exposing device 7 to form an electrostatic latent image corresponding to an image read by the image reading part 3 on the surface of the photosensitive drum 13. The electrostatic latent image is then developed into a toner image of corresponding color by the development device 15 using the toner supplied from the toner container 10. The toner image is first-transferred to a surface of the intermediate transferring belt 8 by the transferring roller 16. The above process is carried out by every image forming unit 9 to form a full color toner image on the intermediate transferring belt 8. The toner remained on the photosensitive drum 13 is removed by the cleaning device 17 and the residual charge of the photosensitive drum 13 is eliminated by the static eliminating device 18.

On the other hand, the sheet fed from the sheet feeding cassette 6 is conveyed to the second transferring part 20 along the sheet conveying path 23 synchronously with the above-mentioned image forming process, and the full color toner image on the intermediate transferring belt 8 is second-transferred on the sheet at the second transferring part 20. The sheet on which the toner image is second-transferred is conveyed downward along the sheet conveying path 23 to enter the fixing device 21. At the fixing device 21, the toner image is fixed on the sheet. The sheet with the fixed toner image is ejected on the ejection tray 5 through the sheet ejection device 22.

Figure 2:
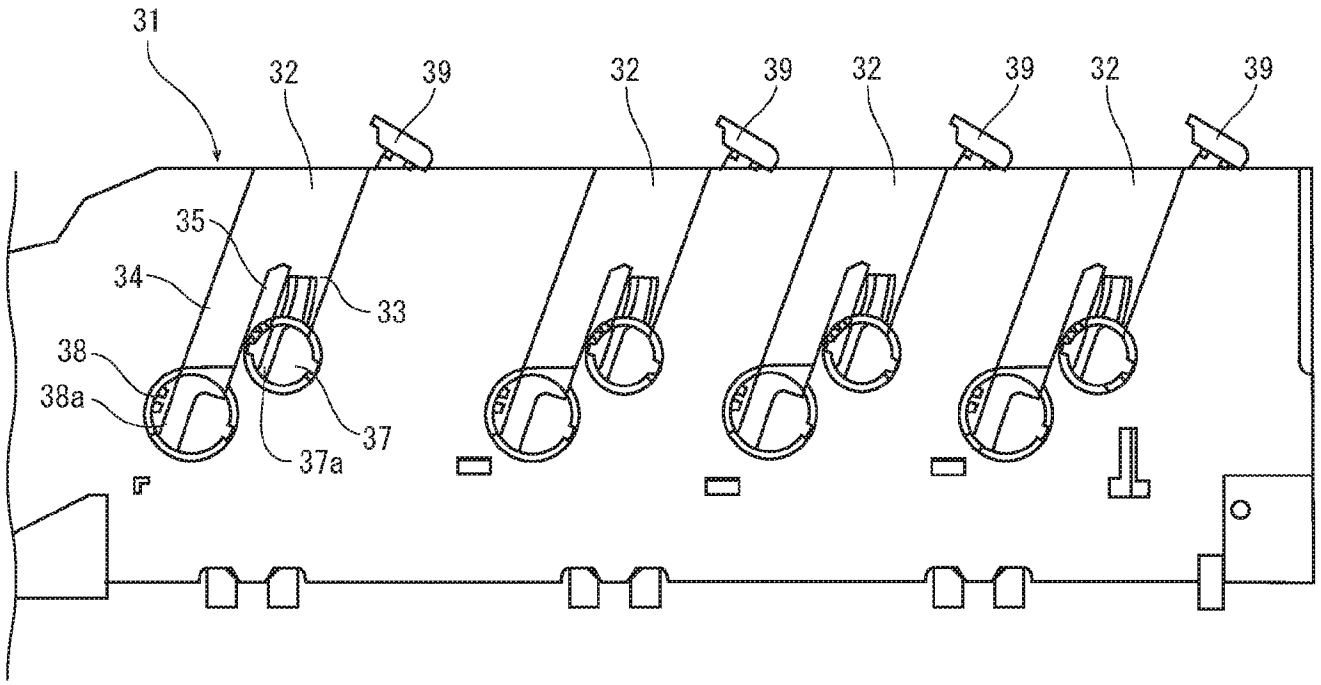
FIG. 2 is a sectional side view showing a front plate of a toner container attachment part, in the color printer according to the embodiment of the present invention.

Next, with reference to FIG. 2, the attachment part 11 for the toner containers 10 will be described. FIG. 2 is a view showing a front plate of the attachment part, viewed from the rear side. The attachment part 11 includes a front plate 31 and a rear plate (not shown) opposing to each other in the front and rear directions. The toner containers 10 are attached between the front and rear plates so as to be arranged side by side in the left and right directions.

On a rear face of the front plate 31, a guide groove 32 is formed at an attachment position of each toner container 10. The guide groove 32 extends from an upper edge of the front plate 31 in a lower oblique direction. The guide groove 32 is branched into a first groove 33 and the second groove 34 from a substantially center in the length direction. The first groove 33 has a length shorter than that of the second groove 34. The first groove 33 and the second groove 34 are divided by a protruded portion 35. At a lower end of the first groove 33, a first rotator 37 is rotatably provided. At a lower end of the second groove 34, a second rotator 38 is rotatably provided. The first rotator 37 and the second rotator 38 respectively have guide grooves 37*a* and 38*a* parallel with an inclining direction of the guide groove 32. The first rotator 37 is integrally formed with a lever 39.

Figure 3:
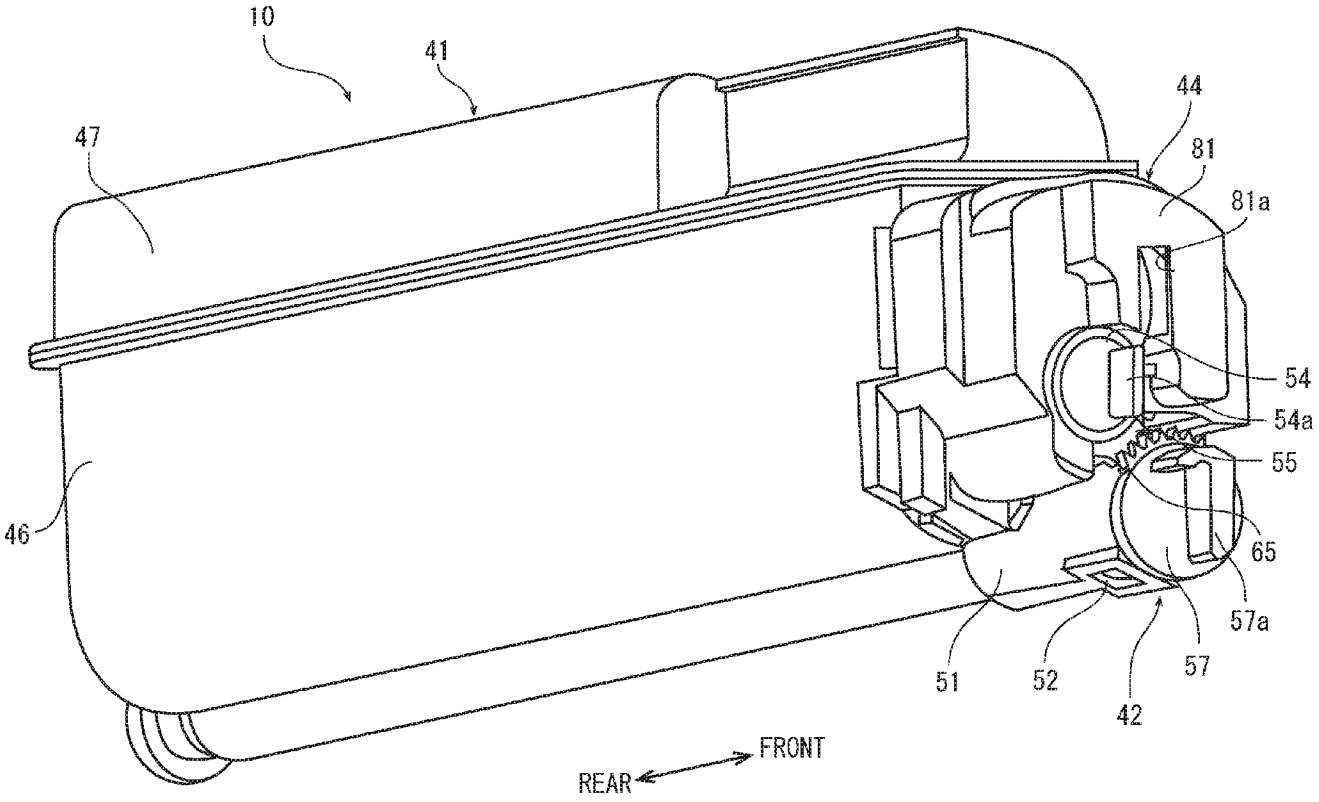
FIG. 3 is a perspective view showing a toner container according to the embodiment of the present invention.
Figure 4:
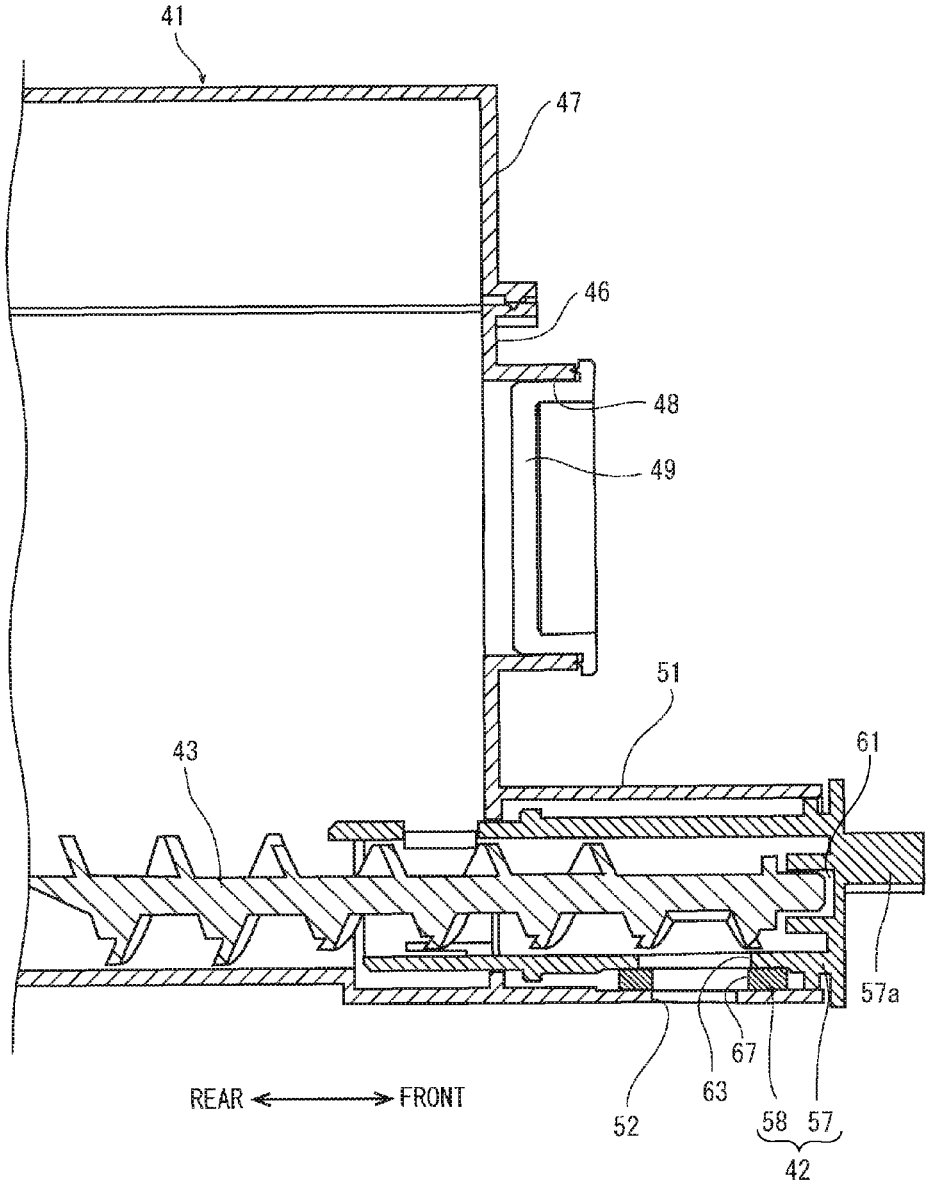
FIG. 4 is a side sectional view showing a front end portion of the toner container according to the embodiment of the present invention.
Figure 5:
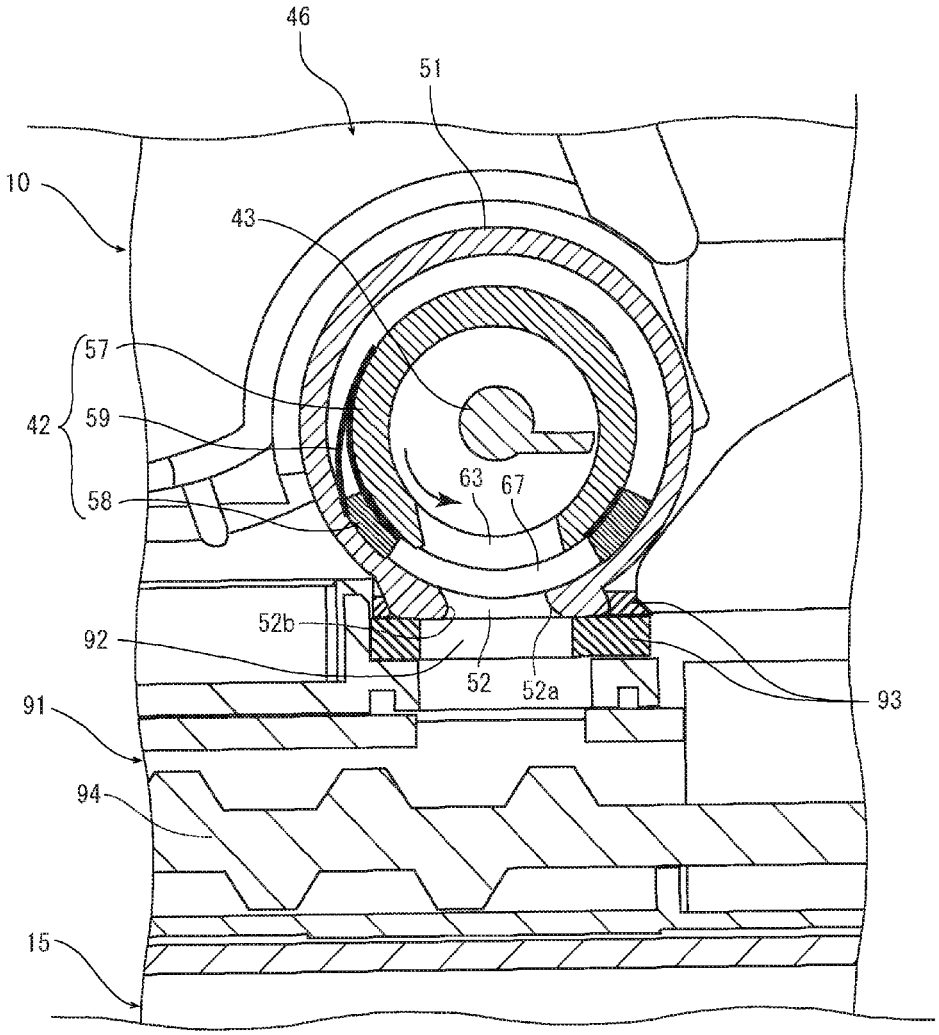
FIG. 5 is a front sectional view showing a shutter mechanism in an opening position, in the toner container according to the embodiment of the present invention.
Figure 6:
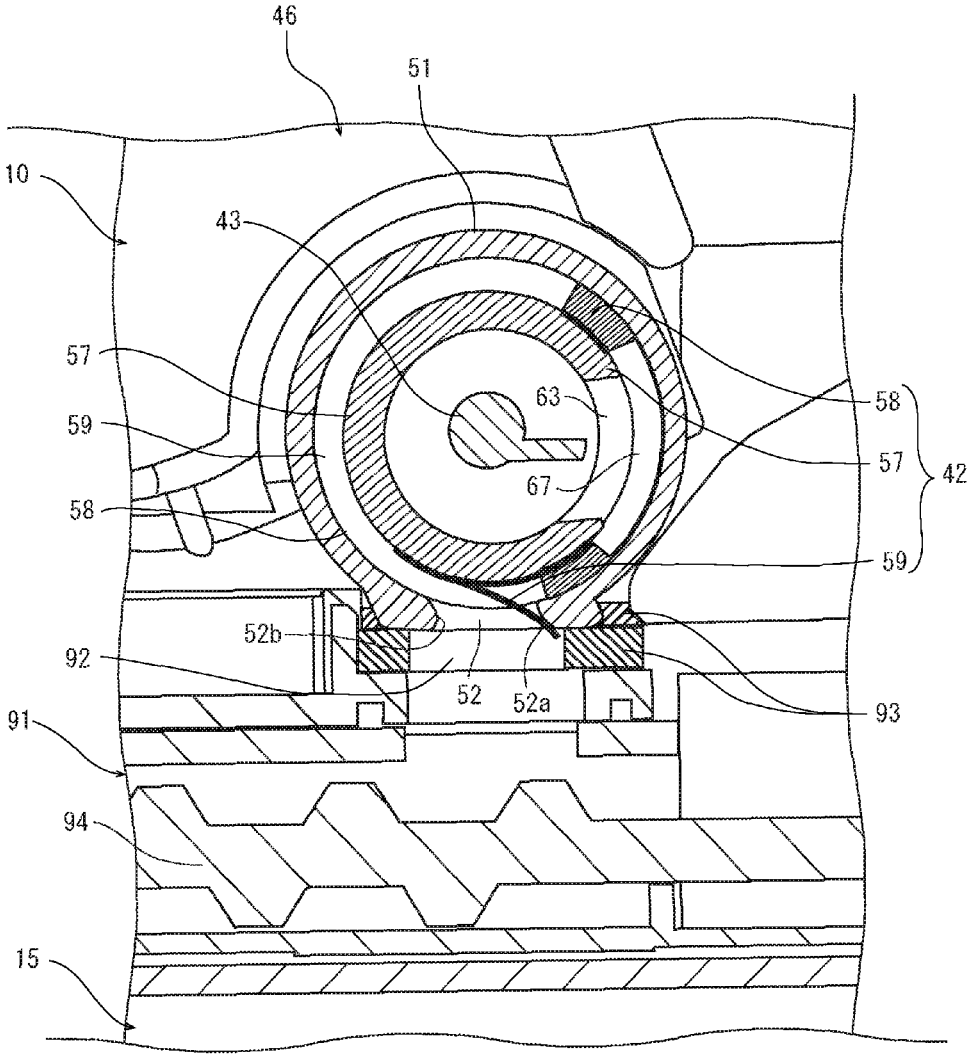
FIG. 6 is a front sectional view showing the shutter mechanism in a closing position, in the toner container according to the embodiment of the present invention.
Figure 7A:
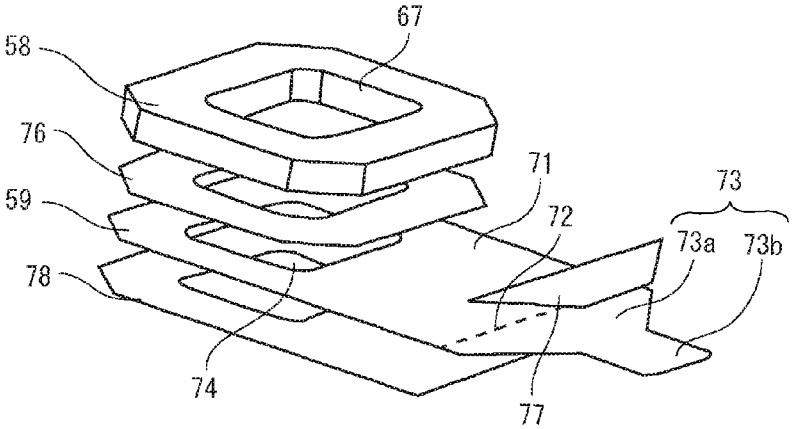
FIG. 7A is a perspective view showing a seal member and a cover member, in the toner container according to the embodiment of the present invention.
Figure 7B:
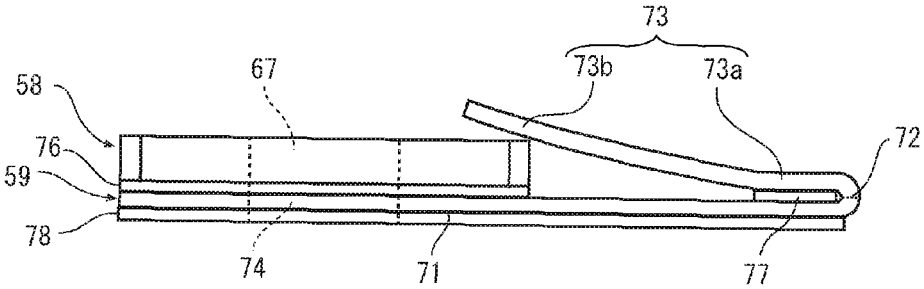
FIG. 7B is a side view showing the seal member and the cover member, in the toner container according to the embodiment of the present invention.
Figure 7C:
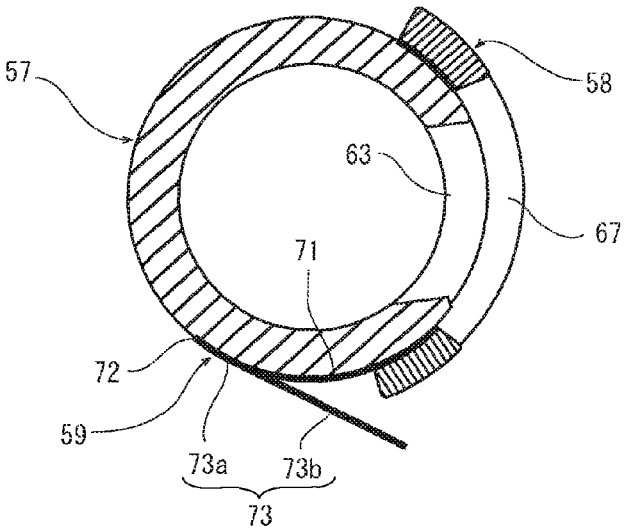
FIG. 7C is a front view showing the seal member and the cover member which are attached to a shutter cylinder, in the toner container according to the embodiment of the present invention.

Next, the toner container 10 will be described with reference to FIG. 3 to FIG. 7. FIG. 3 is a perspective view showing the toner container, FIG. 4 is a side sectional view showing a front end portion of the toner container, FIG. 5 and FIG. 6 are front sectional views showing the front end portion of the toner container, FIG.7A and FIG. 7B are views showing a seal member and a cover member and FIG. 7C is a sectional view showing the seal member and the cover member which are supported to a shutter cylinder (a shutter member).

As shown in FIG. 3, the toner container 10 includes a container main body 41 in which the toner is contained, a shutter mechanism 42 which allows or restricts the replenishment of the toner from the container main body 41 to the development device 15, an agitating paddle (not shown) configured to agitate the toner, a conveying screw 43 (refer to FIG. 4) configured to convey the toner and an attachment cover 44 engaged with the attachment part 11.

The container main body 41 is formed into a long shape in the front and rear directions, and includes a main body 46 opened to an upper face and a lid 47 closing the upper face of the main body 46. As shown in FIG. 4, at an upper portion of a front face of the container main body 41, a filling port 48 is formed. Through the filling port 48, the toner is filled. The filling port 48 is closed with a cap 49 after the toner is filled.

From a lower portion of the front face of the container main body 41, a substantially cylindrical shaped duct 51 is protruded. On a lower face of the duct 51, a replenishment port 52 configured to replenish the toner to the development device 15 is formed. The replenishment port 52 is formed into a rectangular shape, and has edge portions opposing to each other in a circumferential direction of the duct 51. One edge portion 52*a* (a right side edge portion in FIG. 5 and FIG. 6) is inclined in the right lower direction from an inside to an outside and the other edge portion 52*b* (a left side edge portion in FIG. 5 and FIG. 6) is inclined in the right lower direction from the inside to the outside.

As shown in FIG. 3, on the front face of the container main body 41, a rotatable axis part 54 is provided at an upper oblique side of the duct 51. On a front face of the axis part 54, a plate shaped first coupling piece 54*a* is formed. The first coupling piece 54*a* is inclined in the same direction as the guide groove 32 of the attachment part 11. Around an outer circumferential face of the axis part 54, a first gear 55 is formed along the circumferential direction.

The shutter mechanism 42 is stored in the duct 51 protruded from the front face of the container main body 41 so as to be rotatable. As shown in FIG. 5 and FIG. 6, the shutter mechanism 42 includes a substantially cylindrical shaped shutter cylinder 57 (a shutter member), a seal member 58 and a cover member 59 provided on an outer circumferential face of the shutter cylinder 57.

The shutter cylinder 57 is formed into a cylinder shape with a bottom, and has a circular front wall and a cylindrical outer circumferential wall. As shown in FIG. 3, on a front face of the front wall, a plate shaped second coupling piece 57*a* is formed. The second coupling piece 57*a* is inclined in the same direction as the guide groove 32 of the attachment part 11. As shown in FIG. 4, on a rear face of the front wall, a bearing 61 is formed.

On the outer circumferential wall of the shutter cylinder 57, a discharge port 63 is formed. The discharge port 63 has a rectangular shape of which size is larger than that of the replenishment port 52. Around a front end portion of the outer circumferential wall, a second gear 65 with which the first gear 55 is meshed is formed in the circumferential direction.

As shown in FIG. 7A, the seal member 58 is formed into a rectangular shape having a predetermined thickness. On a center of the seal member 58, a rectangular shaped opening 67 which surrounds the circumference of the discharge port 63 is formed. The seal member 58 is made of urethane resin, for example.

The cover member 59 is an elastic deformable sheet like member, and formed integrally with the seal member 58. As shown in FIG. 7A, the cover member 59 has a horizontally long rectangular shaped base part 71 and an extending part 73 connected to one short side edge of the base part 71 via a perforation 72 (a folding portion). The base part 71 has an opening 74 corresponding to the opening 67 of the seal member 58. The extending part 73 has an adhesion portion 73*a* tapered from the perforation 72 toward the tip and a rectangular shaped tip end portion 73*b* connected to the tip of the adhesion portion 73*a*. The tip end portion 73*b* has a width substantially equal to a width of the replenishment port 52. The cover member 59 is made of polyethylene terephthalate (PET), for example.

As shown in FIG. 7A and FIG. 7B, to one face of the base part 71, the seal member 58 is adhered around the opening 74 with a double-sided adhesive tape 76 so that the opening 74 is communicated with the opening 67 of the seal member 58. The extending part 73 is folded along the perforation 72, and the adhesion portion 73*a* is adhered to the base part 71 with a double-sided adhesive tape 77. That is, the extending part 73 is folded by 180 degrees along the perforation 72. When the extending part 73 is folded, the tip end portion 73*b* extends so as to overlap with the seal member 58. The tip end portion 73*b* does not reach the opening 67 of the seal member 58. To the other face of the base part 71, a double-sided adhesive tape 78 is adhered.

As shown in FIG. 7C, the cover member 59 which is adhered to the seal member 58 is positioned such that the opening 67 of the seal member 58 is communicated with the discharge port 63 of the shutter cylinder 57, wound around the outer circumferential wall of the shutter cylinder 57 in the circumferential direction and then adhered to the outer circumferential wall with the double-sided adhesive tape 78 (not shown in FIG. 7C). Because the outer circumferential wall of the shutter cylinder 57 is curved and the cover member 59 is made of the elastic deformable sheet like member, although the base part 71 is curved along the outer circumferential wall, the tip end portion 73*b* extends straightly from the adhesion portion 73*a* along a tangential direction of the outer circumferential wall in a direction of the opening 67.

As shown in FIG. 5 and FIG. 6, the shutter cylinder 57 is stored in the duct 51 of the container main body 41 so as to be rotatable along an inner circumferential face of the duct 51. The seal member 58 is interposed between the shutter cylinder 57 and the duct 51 and compressed in the thickness direction. The cover member 59 is stored between the inner circumferential face of the shutter cylinder 57 and the outer circumferential face of the duct 51 with a compressed posture. The tip end portion 73*b* of the extending part 73 is held between the duct 51 and the seal member 58 to be elastically deformed into a curved shape along the inner circumferential face of the duct 51.

The agitating paddle is supported such that a front end thereof is rotatbly supported to the rear face of the axis part 54 formed on the front wall of the container main body 41 and a rear end thereof is rotatably supported to a rear wall of the container main body 41.

The conveying screw 43 is supported such that a front end thereof is rotatably supported to the bearing 61 of the shutter cylinder 57 and a rear end thereof is rotatably supported to the rear wall of the container main body 41.

The rear ends of the agitating paddle and the conveying screw 43 penetrate through the real wall of the container main body 41, and are coupled to a drive source (not shown) via drive gears (not shown). When the drive source drives the agitating paddle, the toner in the container main body 41 is agitated. When the conveying screw 43 is rotated, the toner in the container main body 41 is conveyed to the duct 51.

As shown in FIG. 3, the attachment cover 44 is attached to the front face of the container main body 41 above the duct 51 and the axis part 54. On a font face of the attachment cover 44, a block shaped positioning protruded part 81 is formed. The positioning protruded part 81 has a slit 81*a* opened to a lower face. The positioning protruded part 81 has a width equal to that of the guide groove 32 of the attachment part 11, and the slit 81*a* has a width substantially equal to that of the protruded portion 35 of the attachment part 11.

A way for replenishing the toner from the toner container 10 having the above described configuration to the development device 15 will be described. First of all, a way for attaching the toner container 10 to the attachment part 11 will be described with reference to FIG. 1 to FIG. 3. First, the positioning protruded part 81 of the attachment cover 44 is inserted into the guide groove 32 formed in the front plate 31. The positioning protruded part 81 is guided along the guide groove 32 in the lower oblique direction. Then, the first coupling piece 54*a* of the axis part 54 is guided along the first groove 33 and the second coupling piece 57*a* of the shutter cylinder 57 is guided along the second groove 34. The positioning protruded part 81 is slid until the slit 81*a* is engaged with the protruded portion 35. When the first coupling piece 54*a* reaches the lower end of the first groove 33, it is engaged with the guide groove 37*a* of the first rotator 37. When the second coupling piece 57*a* reaches the lower end of the second groove 34, it is engaged with the guide groove 38*a* of the second rotator 38. Thereby, the toner container 10 is attached to the attachment part 11.

As shown in FIG.5 and FIG. 6, under the attachment part 11, a relay conveying part 91 is formed between the toner container 10 and the development device 15. The relay conveying part 91 has a receiving port 92 corresponding to the replenishment port 52 of the toner container 10. Around the receiving port 92, two-stepped ring-shaped seal members 93 are arranged. In the relay conveying part 91, a conveying screw 94 is provided so as to convey the developer replenished from the toner container 10 to a replenishment port (not shown) of the development device 15.

After the toner container 10 is attached to the attachment part 11, on rotating the lever 39, the first rotator 37 is rotated together with the lever 39 and the axis part 54 is rotated together with the first rotator 37 via the first coupling piece 54*a*. In addition, when the axis part 54 is rotated, the second coupling piece 57*a* is rotated in an opposing direction to the rotating direction of the first coupling piece 54*a* via the first and second gears 55 and 65. By the rotating of the second coupling piece 57*a*, the shutter cylinder 57 is rotated in the duct 51 to open and close the replenishment port 52.

Figure 8:
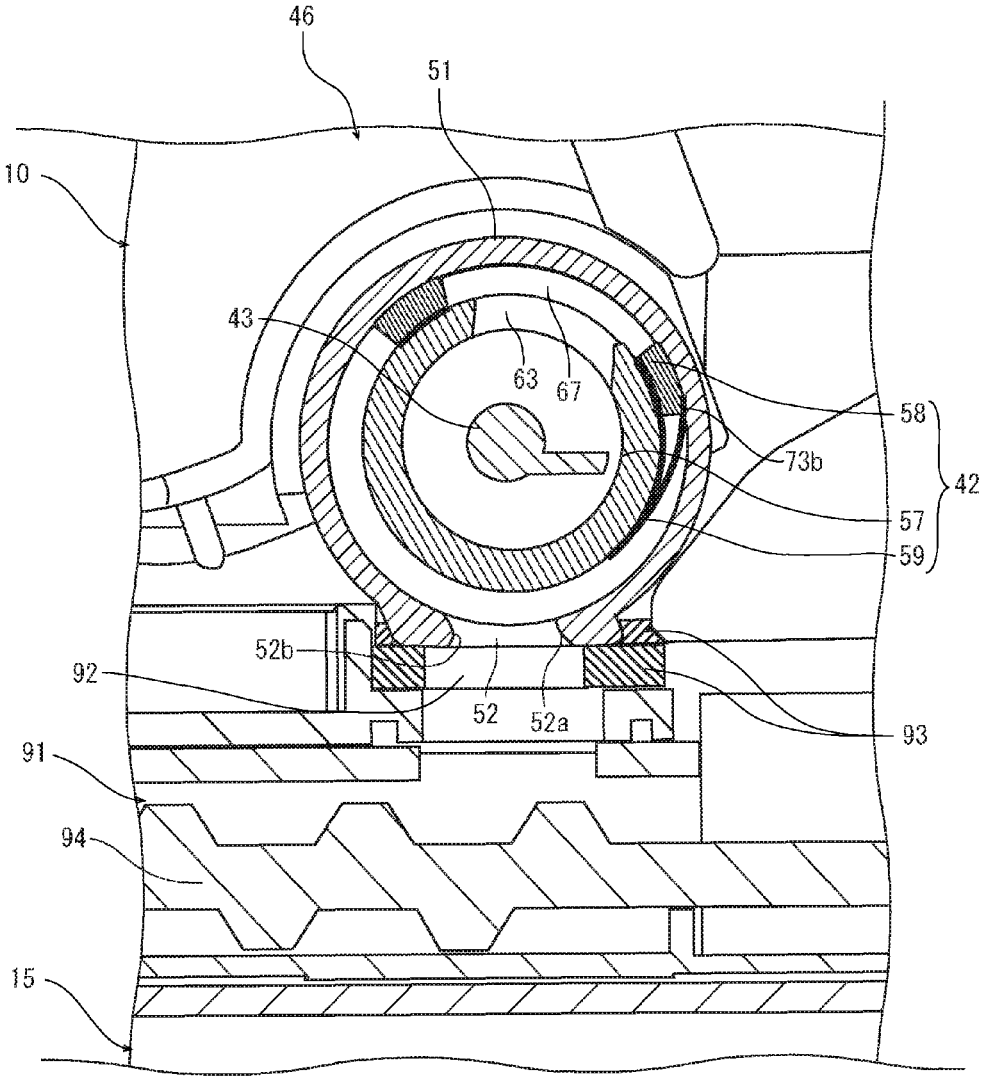
FIG. 8 is a front sectional view showing the shutter mechanism in shipping, in the toner container according to the embodiment of the present invention.
Figure 9A:
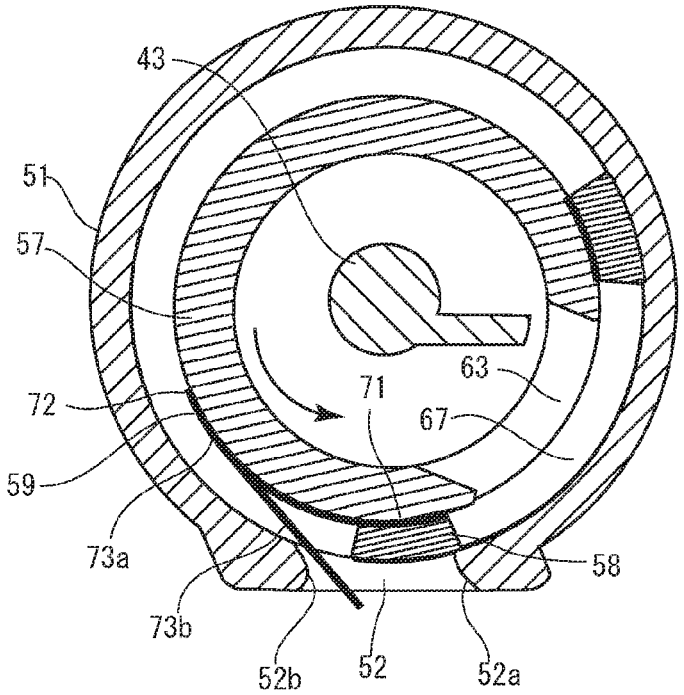
FIG. 9A is a view showing the cover member in a state where a tip end portion of the cover member reaches a replenishment port, in the toner container according to the embodiment of the present invention.
Figure 9B:
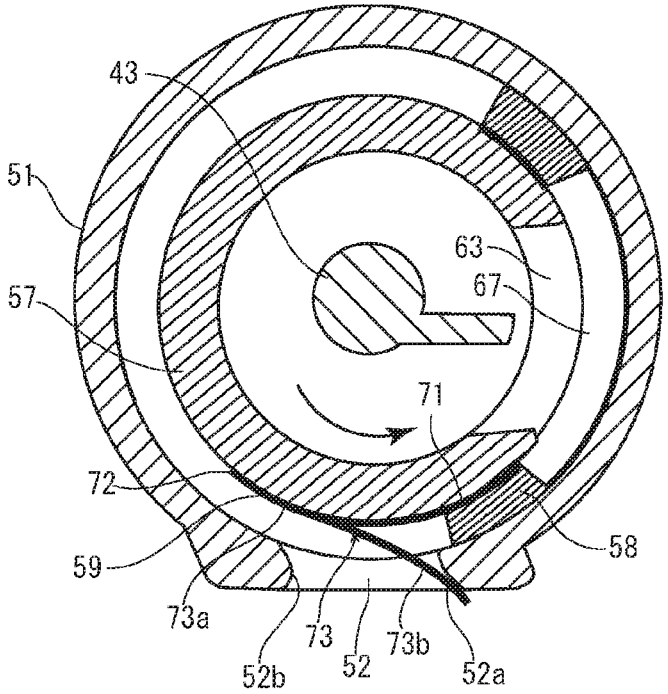
FIG. 9B is a view showing the cover member in a state where the tip end portion of the cover member reaches a side face of the replenishment port, in the toner container according to the embodiment of the present invention.

Next, an opening and closing operation of the shutter mechanism 42 will be described with reference to FIG. 5, FIG. 6, FIG. 8, FIG. 9A and FIG. 9B. FIG. 8 is a side sectional view showing the shutter mechanism in shipping of the toner container, and FIG. 9A and FIG. 9B are side sectional views showing a change in shape of the cover member as the shutter cylinder is rotated.

In shipping of the toner container 10, as shown in FIG. 8, the discharge port 63 of the shutter cylinder 57 is retracted from the replenishment port 52 of the duct 51. The tip end portion 73*b* of the cover member 59 is held between the seal member 58 and the duct 51 to be kept in a posture curved along the inner circumferential face of the duct 51.

When the shutter mechanism 42 is opened or closed at the attachment and detachment of the toner container 10, the shutter cylinder 57 is rotated in the counterclockwise direction (a closing direction) from the opening position shown in FIG. 5 to the closing position shown in FIG. 6 and in the clockwise direction (an opening direction) from the closing position to the opening position. A rotating range of the shutter mechanism 42 is restricted by the lever 39.

When the toner is discharged from the toner container 10 firstly after the shipping, the shutter cylinder 57 is rotated in the clockwise direction in FIG. 8 to the opening position shown in FIG. 5. In the opening position shown in FIG. 5, the discharge port 63 of the shutter cylinder 57 is communicated with replenishment port 52, and the toner is discharged from the discharge port 63 through the replenishment port 52 into the relay conveying part 91. The toner is conveyed in the conveying part 91 and then replenished through the replenishment port of the development device 15. The cover member 59 is retracted from the replenishment port 52, and the tip end portion 73*b* of the extending part 73 is held between the seal member 58 and the duct 51 to be curved into an arc-shape along the inner circumferential face of the duct 51.

When the shutter cylinder 57 is rotated in the closing direction, the tip end portion 73*b* of the extending part 73 of the cover member 59 is slid along the inner circumferential face of the duct 51 as-held between the seal member 58 and the duct 51.

When the shutter cylinder 57 is rotated to the closing position shown in FIG. 6, the discharge port 63 is retracted form the replenishment port 52, and the replenishment port 52 is closed with the outer circumferential wall of the shutter cylinder 57 to restrict the discharge of the toner from the container main body 41. Because the extending part 73 of the cover member 59 is provided on a near side from the discharge port 63 of the shutter cylinder 57 in the closing direction, the extending part 73 reaches the replenishment port 52 after the discharge port 63 is retracted from the replenishment port 52 and the seal member 58 is retracted from the replenishment port 52.

When the tip end portion 73*b* of the extending part 73 reaches the replenishment port 52, as shown in FIG. 9A, the tip end portion 73*b* is released into a shape extending straightly in the tangential direction of the outer circumferential wall of the shutter cylinder 57. When the shutter cylinder 57 is further rotated in the closing direction, as shown in FIG. 9B, the tip end portion 73*b* enters the replenishment port 52 and is moved in the replenishment port 52. Then, an inner face of the tip end portion 73*b* comes into contact with the downstream side edge portion 52*a* of the replenishment port 52 in the closing direction from the lower side. The tip end portion 73*b* comes into contact with the edge portion 52*a*, is deformed so as to be warped outside and pressed against the edge portion 52*a* with elastic force.

Figure 10:
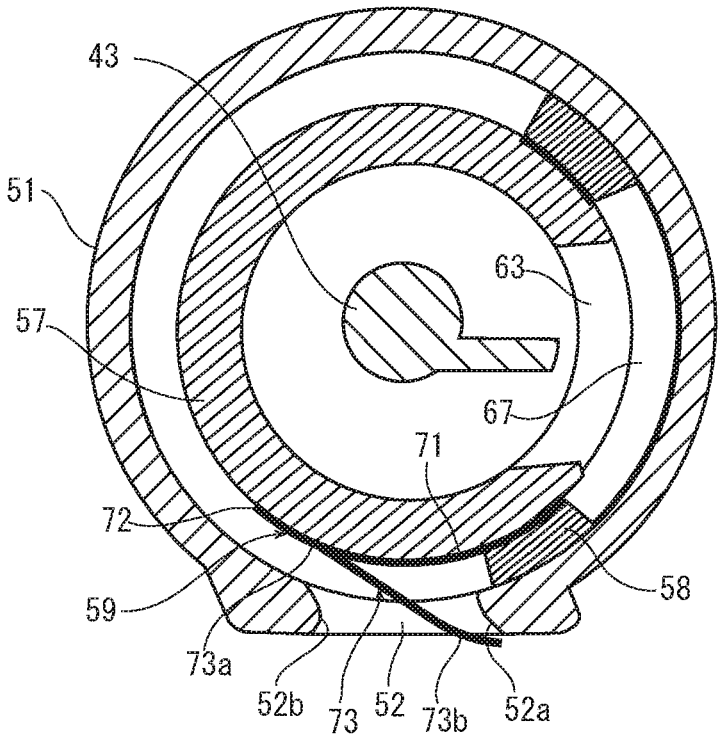
FIG. 10 is a side sectional view showing the cover member which is elastically deformed, in the toner container according to the embodiment of the present invention.
Figure 11A:
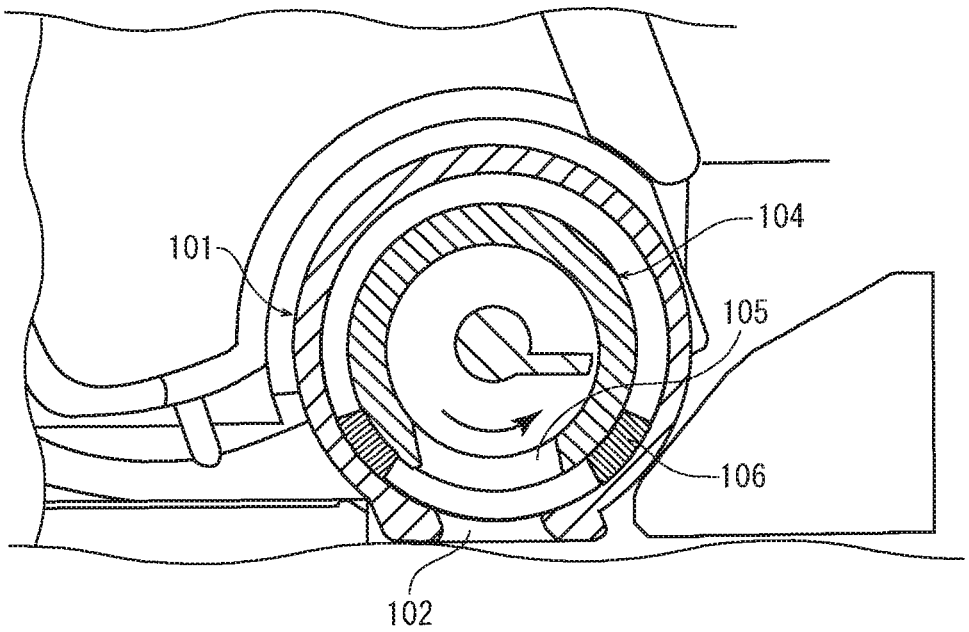
FIG. 11A is a side sectional view showing the accumulated toner in a conventional toner container.
Figure 11B:
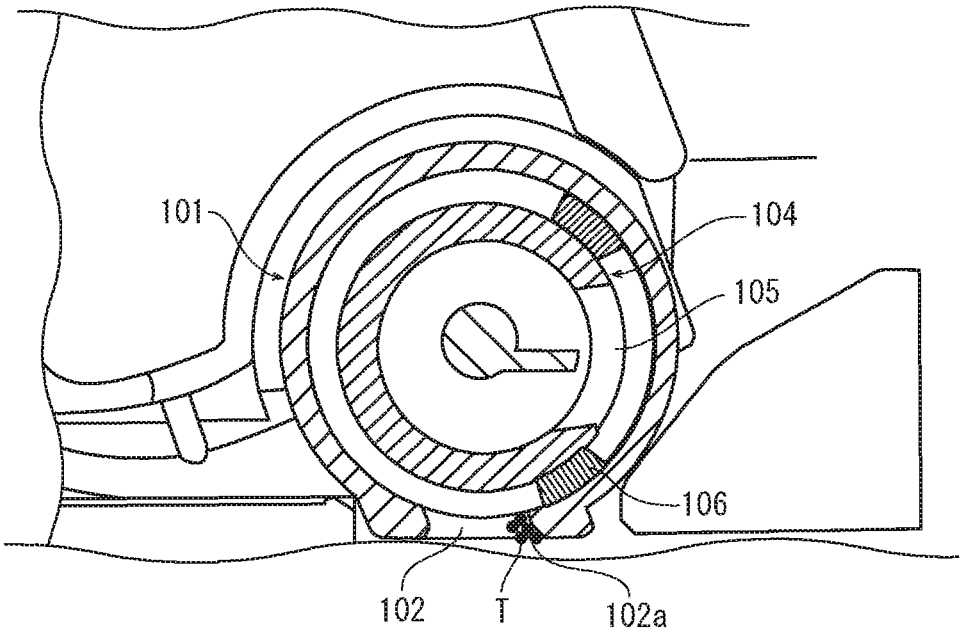
FIG. 11B is a side sectional view showing the accumulated toner in the conventional toner container.

Additionally, when the cover member 59 is held between the seal member 58 and the duct 51, the tip end portion 73*b* of the extending part 73 may be plastically deformed into an arc-shape along the inner circumferential face of the duct 51. In this case, as shown in FIG. 10, the tip end portion 73*b* may cover the edge portion 52*a* of the replenishment port 52 from the lower side.

When the shutter cylinder 57 is rotated in the opening direction, the tip end portion 73*b* of the extending part 73 of the cover member 59 is moved in the replenishment port 52 and then is slid along the inner circumferential face of the duct 51 as-held between the duct 51 and the seal member 58.

Next, an experimental result of the toner container 10 according to the present embodiment for the toner contamination around the replenishment port 52 will be described.

After the toner container 10 is filled with the toner and then shaken to agitate the toner, the toner container 10 is attached to the attachment part 11. After the attachment, the shutter cylinder 57 of the shutter mechanism 42 of the toner container 10 is rotated in the opening position and the closing position, and then the toner container 10 is detached from the attachment part 11. The attachment and detachment is repeated for three times and then the replenishment port 52 of the toner container 10 is cleaned with a cleaner. One work including the three times of attachment and detachment and one time of the cleaning is repeated for a predetermined times.

As a result, after 15 times of the works, some degree of toner contamination is observed, and the toner contamination gradually proceeds till 60 times of the works. However, the toner contamination is observed only around the replenishment port 52. After the 60 times of the works, an original color of the toner container 10 can be sufficiently seen around the replenishment port 52. On the contrary, in a conventional toner container, after 15 times of the works, some degree of toner contamination is observed, and the toner contamination proceeds till 60 times of the works. The toner contamination area is larger than that of the toner container 10 according to the present embodiment. In addition, the fallen toner lump has a size larger than that of the toner container 10 according to the present embodiment. Furthermore, after 60 times of the works, a vicinity of the replenishment port 52 is contaminated such that it is difficult to visually recognize an original color of the toner container.

As described above, according to the toner container 10 of the present invention, when the replenishment port 52 is closed, the tip end portion 73*b* of the cover member 59 comes into contact with the downstream side edge portion 52*a* of the replenishment port 52 in the closing direction so that the toner adhered on the edge portion 52*a* is held between the tip end portion 73*b* and the edge portion 52*a*. Accordingly, it becomes possible to prevent the toner accumulated on the edge portion 52*a* from being fallen and to prevent the toner contamination caused by the toner falling. The toner adhered on the edge portion 52*a* is fallen through the replenishment port 52 every opening operation of the shutter mechanism 42.

When the toner container 10 is detached from the attachment part 11, the shutter cylinder 57 is rotated in the closing position and the edge portion 52*a* is covered with the tip end portion 73*b* of the cover member 59. Accordingly, when the detached toner container 10 is set on a desk or the others, it becomes possible to prevent the adhered toner from falling on the desk or the others.

The cover member 59 is provided on the shutter cylinder 57 so as to extend in the tangential direction of the shutter cylinder 57 from an upstream side from the discharge port 63 in the closing direction. Accordingly, when the shutter cylinder 57 is rotated in the closing direction and the extending part 73 reaches the replenishment port 52, the tip end portion 73*b* of the extending part 73 is automatically released so as to extend in the replenishment port 52 and come into contact with the edge portion 52*a*.

In addition, the seal member 58 and the cover member 59 are integrally formed. This allows easy mounting of the cover member 59 to the shutter cylinder 57. In addition, this allows post-mounting of the cover member 59 to a shutter mechanism of an existing image forming apparatus.

In addition, the base part 71 and the extending part 73 of the cover member 59 are folded at 180 degrees along the perforation 72. Accordingly, when the base part 71 is adhered to the shutter cylinder 57, the extending part 73 automatically extends in the tangential direction from the upstream side of the discharge port 63 of the shutter cylinder 57 in the closing direction. Furthermore, because the extending part 73 and the base part 71 are adhered at the adhesion portion 73*a*, the extending part 73 is kept in a posture extending straightly in the tangential direction of the shutter cylinder 57. Thereby, when the extending part 73 comes into contact with the edge portion 52*a* of the replenishment port 52, the extending part 73 deforms so as to be warped outside. Accordingly, large force can be applied against the edge portion 52*a* by the elastic force of the cover member 59 so that it becomes possible to keep the toner adhered on the edge portion 52*a* with the extending part 73.

In the shipping state shown in FIG. 8, the tip end portion 73*b* of the extending part 73 of the cover member 59 is curved into an arc-shape along the inner circumferential face of the duct 51. If the cover member 59 is left in the posture for a long period, the tip end portion 73*b* may be plastically deformed in the arc-shaped curved posture. In a case of the arc-shaped curved posture, as shown in FIG. 10, the tip end portion 73*b* comes into contact with the edge portion 52*a* and goes around the lower side of the edge portion 52*a* so that the toner falling can be prevented surely. Comparing the toner contamination between the curved tip end portion 73*b* of the cover member 59 and the straight tip end portion 73*b* of the cover member 59, the curved tip end portion 73*b* can provide a higher effect for reducing the toner contamination. Alternatively, the tip end portion 73*b* may be an arc-shaped curved original shape.

The embodiments of the present disclosure were described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. A toner container comprising:

a container main body having a replenishment port of toner and containing the toner; and a shutter mechanism which opens and closes the replenishment port, wherein the shutter mechanism includes:

a shutter member having a discharge port corresponding to the replenishment port; and a cover member supported by the shutter member so as to extend in a direction of the replenishment port, wherein the shutter member is movable between an opening position where the discharge port is communicated with the replenishment port to open the replenishment port and a closing position where the discharge port is retracted from the replenishment port to close the replenishment port, the shutter member being movable in an opening direction from the closing position to the opening position and in a closing direction from the opening position to the closing position, the closing direction being opposite to the opening direction, wherein the cover member has a tip end portion, the tip end portion extends toward the replenishment port as the shutter member moves from the opening position to the closing position, comes into contact with a downstream side edge portion of the replenishment port in the closing direction at the closing position and retracts from the replenishment port as the shutter member moves in the opening direction.

2. The toner container according to claim 1, wherein the replenishment port is formed on a duct having a cylindrical shape and protruding from the container main body, the shutter member has a cylindrical shape and is fitted into the duct so as to be rotatable between the opening position and the closing position along an inner circumferential face of the duct, the cover member is made of an elastic deformable sheet and includes:

an extending part having the tip end portion and extending from an upstream side of the discharge port to a downstream side in the closing direction so as to separate from an outer circumferential face of the shutter member; and a base part supported to the outer circumferential face of the shutter member on the upstream side of the discharge port in the closing direction, the extending part is stored in an elastically deformed posture between an outer circumferential face of the shutter member and an inner circumferential face of the duct at the opening position and the extending part is released into a shape separated from the outer circumferential face of the shutter member and extending in the replenishment port at the closing position.

3. The toner container according to claim 2, wherein the shutter mechanism further includes a seal member supported around the discharge port of the shutter member and interposed between the duct and the discharge port, the cover member is formed integrally with the seal member.

4. The toner container according to claim 3, wherein the cover member has a folding portion along which the extending part is folded relative to the base part, one side face of the base part is supported to one side face of the seal member and the other side face of the base part is supported to the outer circumferential face of the shutter member, the extending part extends such that the tip end portion overlaps with the other side face of the seal member.

5. The toner container according to claim 4, wherein, in the cover member, a base end portion of the extending part folded along the folding portion is adhered to the base part.

6. The toner container according to claim 4, wherein the seal member has a predetermined thickness, the tip end portion of the extending part of the cover member is held between the seal member and the duct so as to have a curved shape along the inner circumferential face of the duct.

7. The toner container according to claim 4, wherein the discharge port has a width in an axis direction perpendicular to a circumferential direction of the shutter member larger than a width of the replenishment port in the axis direction, the base part of the cover member has an opening corresponding to the discharge port, a width of the tip end portion in the axis direction is nearly equal to the width of the replenishment port, and the extending part is formed such that a width in the axis direction is narrowed from the folding portion to the tip end portion.

8. The toner container according to claim 1, wherein the downstream side edge portion of the replenishment port in the closing direction has an inclined face inclined to the downstream side in the closing direction from an inside to an outside of the replenishment port.

9. An image forming apparatus including the toner container according to claim 1.

* * * * *